United States Patent [19]

Hara et al.

[11] Patent Number: 4,543,300

[45] Date of Patent: Sep. 24, 1985

[54] IRON-ZINC ALLOY ELECTRO-GALVANIZED STEEL SHEET HAVING A PLURALITY OF IRON-ZINC ALLOY COATINGS

[75] Inventors: Tomihiro Hara; Takeshi Adaniya; Masaru Sagiyama, all of Yokohama; Tsutomu Watanabe, Fukuyama; Takashi Shimoma, Yokohama; Masaru Nabatame, Fukuyama, all of Japan

[73] Assignee: Nippon Kokan Kabushiki Kaisha, Tokyo, Japan

[21] Appl. No.: 604,993

[22] Filed: Apr. 27, 1984

[30] Foreign Application Priority Data

May 14, 1983 [JP] Japan ..... 58-84761

[51] Int. Cl.[4] ..... C23C 1/02

[52] U.S. Cl. ..... 428/610; 428/659; 428/684

[58] Field of Search ..... 428/659, 635, 636, 610, 428/684

[56] References Cited

FOREIGN PATENT DOCUMENTS

| | | | |
|---|---|---|---|
| 0140867 | 8/1982 | Japan | 428/659 |
| 58-15554 | 3/1983 | Japan | 428/659 |
| 58-67886 | 4/1983 | Japan | 428/659 |

OTHER PUBLICATIONS

Toda, H. et al., "Development of Two-Layered Zn-Fe Alloy Electroplated Steel Sheet-New Coated Steel Sheet for Automotive Body", SAE 840212 (1984).

Ito, K. et al., "Properties of Zn-Fe Alloy Electroplated Steel Sheets", SAE 840214 (1984).

*Primary Examiner*—L. Dewayne Rutledge

*Assistant Examiner*—Deborah Yee

*Attorney, Agent, or Firm*—Frishauf, Holtz, Goodman & Woodward

[57] ABSTRACT

An iron-zinc alloy electro-galvanized steel sheet having a plurality of iron-zinc alloy coatings, which comprises: at least one iron-zinc alloy coating as the lower layer, formed on the surface of a steel sheet, and at least two iron-zinc alloy coatings as the upper layer, formed on the at least one iron-zinc alloy coating as the lower layer. The ratio of iron content to the coating weight of each of the at least one iron-zinc alloy coating as the lower layer is within the range of from 1 to 15 wt. %, and the total coating weight of the at least one iron-zinc alloy coating as the lower layer is within the range of from 1 to 50 g/m$^2$ per side of the steel sheet. The ratio of iron content to the coating weight of each of the at least two iron-zinc alloy coatings as the upper layer is over 15 wt. %, the ratio of iron content to the coating weight gradually increases from the innermost coating toward the outermost coating of the at least two iron-zinc alloy coatings as the upper layer, the difference in the ratio or iron content to the coating weight between two adjacent coatings of the at least two iron-zinc alloy coatings as the upper layer is within the range of from 1 to 15 wt. %, and the total coating weight of the at least two iron-zinc alloy coatings as the upper layer is within the range of from 1 to 40 g/m$^2$ per side of the steel sheet. The difference in the ratio of iron content to the coating weight between the uppermost coating of the at least one iron-zinc alloy coating as the lower layer and the lowermost coating of the at least two iron-zinc alloy coatings as the upper layer is within the range of from 1 to 15 wt. %. The sum of the total coating weight of the at least one iron-zinc alloy coating as the lower layer and the total coating weight of the at least two iron-zinc alloy coatings as the upper layer is within the range of from 10 to 75 wt. % per side of the steel sheet.

10 Claims, 7 Drawing Figures

IRON-ZINC ALLOY ELECTRO-GALVANIZED STEEL SHEET HAVING A PLURALITY OF IRON-ZINC ALLOY COATINGS

REFERENCE TO PATENTS, APPLICATIONS AND PUBLICATIONS PERTINENT TO THE INVENTION

As far as we know, the prior art documents pertinent to the present invention are as follows:

(1) Japanese Patent Publication No. 58-15,554 dated Mar. 26, 1983; and (2) Japanese Patent Provisional Publication No. 58-67,886 dated Apr. 22, 1983.

The contents disclosed in the above-mentioned prior art documents will be discussed hereafter under the heading of the "Background of the Invention".

FIELD OF THE INVENTION

The present invention relates to an iron-zinc alloy electro-galvanized steel sheet excellent in bare corrosion resistance of the iron-zinc alloy coating itself and corrosion resistance after painting, which is not susceptible to powdery peeloff of the iron-zinc alloy coating even through a severe forming such as that by a press, for example.

BACKGROUND OF THE INVENTION

There is a strong demand from automotive manufacturers and other users for a plated steel sheet having an excellent corrosion resistance even in a severe corrosive environment and capable of improving durability of the product. As a galvanized steel sheet capable of coping with such a demand, the iron-zinc alloy galvanized steel sheet having an iron-zinc alloy coating formed on at least one surface of a steel sheet is known. The iron-zinc alloy galvanized steel sheet has many practical advantages such as an excellent corrosion resistance after painting, a low manufacturing cost and easy reuse of scrap thereof as an iron source after melting.

The following processes for manufacturing such an iron-zinc alloy galvanized steel sheet are known:

(1) Alloying process:

By rapidly heating and then rapidly cooling a zinc-galvanized steel sheet having a zinc coating formed on at least one surface of a steel sheet, the zinc coating is converted into an iron-zinc alloy coating.

(2) Electro-galvanizing process:

By subjecting a steel sheet to an electro-galvanizing treatment in a galvanizing bath mainly comprising zinc ions and iron ions, an iron-zinc alloy coating is formed on at least one surface of the steel sheet.

However, the iron-zinc alloy galvanized steel sheet manufactured by the alloying process described under (1) above is hardened since the iron-zinc alloy galvanized steel sheet is rapidly heated and then rapidly cooled to convert the zinc coating into an iron-zinc alloy coating. Therefore, the iron-zinc alloy galvanized steel sheet manufactured by the alloying process has a problem in that cracks and wrinkles are caused in the steel sheet when applying a severe forming such as that by a press.

The iron-zinc alloy electro-galvanized steel sheet manufactured by the electro-galvanizing process described under (2) above, in contrast, is not hardened since it is not applied with rapid heating and rapid cooling as the iron-zinc alloy galvanized steel sheet manufactured by the alloying process. Therefore, the iron-zinc alloy electro-galvanized steel sheet manufactured by the electro-galvanizing process does not pose the problem of occurrence of cracks or wrinkles in the steel sheet even by applying a severe forming such as that by a press. The iron-zinc alloy electro-galvanized steel sheet manufactured by the electro-galvanizing process is suitable for use as the outer sheet of car because of the excellent formability.

However, the iron-zinc alloy galvanized steel sheet manufactured by the alloying process and the iron-zinc alloy electro-galvanized steel sheet manufactured by the electro-galvanizing process have a drawback of being susceptible to powdery peeloff (hereinafter referred to as "powdering") of the iron-zinc alloy coating when subjected to a severe forming such as that by a press. However, almost no measure has so far been taken against occurrence of such powdering.

On the other hand, a cationic type electro-depositing process is popularly applied by automotive and other manufacturers to form a paint film on the surface of an iron-zinc alloy galvanized steel sheet. However, when forming a paint film on the surface of an iron-zinc alloy galvanized steel sheet by the cationic type electro-depositing process, hydrogen gas produced during electro-deposition and entrapped in the paint film causes generation of crater-like pinholes in the paint film. Since these crater-like pinholes produced in the paint film form a defect in appearance of the paint film surface, it is necessary to prevent occurrence thereof. Crater-like pinholes tend to occur when the ratio of zinc content to the coating weight is high. Occurrence of pinholes can therefore be prevented by reducing the ratio of zinc content to the coating weight, whereas a lower ratio of zinc content to the coating weight leads to deterioration of bare corrosion resistance of the iron-zinc alloy coating itself.

As an iron-zinc alloy galvanized steel sheet serving to solve the above-mentioned problems, an iron-zinc alloy galvanized steel sheet for cationic electro-deposition of paint having a plurality of iron-zinc alloy coatings is disclosed in Japanese Patent Publication No. 58-15,554 dated Mar. 26, 1983, which comprises:

at least one iron-zinc alloy coating as the lower layer, formed on at least one surface of a steel sheet, the ratio of zinc content to the coating weight of each of said at least one iron-zinc alloy coating as the lower layer being over 40 wt.%; and an iron-zinc alloy coating as the upper layer, formed on said at least one iron-zinc alloy coating as the lower layer, the ratio of zinc content to the coating weight of said iron-zinc alloy coating as the upper layer being up to 40 wt.% (hereinafter referred to as the "prior art 1").

The above-mentioned prior art 1 involves the following problems:

(1) When applying a severe forming such as that by a press, powdering may be caused in the at least one iron-zinc alloy coating as the lower layer and the iron-zinc alloy coating as the upper layer.

(2) A considerable difference in the ratio of zinc content to the coating weight between the uppermost coating of the at least one iron-zinc alloy coating as the lower layer and the iron-zinc alloy coating as the upper layer leads to a large difference in the electrode potential between the uppermost coating of the at least one iron-zinc alloy coating as the lower layer and the iron-zinc alloy coating as the upper layer, and this causes galvanic corrosion in the iron-zinc alloy coatings, thus deteriorating bare corrosion resistance of the iron-zinc alloy coating itself and corrosion resistance after painting.

On the other hand, as an iron-zinc alloy electro-galvanized steel sheet excellent in bare corrosion resistance of the iron-zinc alloy coating itself and corrosion resistance after painting, an iron-zinc alloy electro-galvanized steel sheet having a plurality of iron-zinc alloy coatings is disclosed in Japanese Patent Provisional Publication No. 58-67,886 dated Apr. 22, 1983, which comprises:

a plurality of iron-zinc alloy coatings formed on at least one surface of a steel sheet, the ratio of zinc content to the coating weight of each of said plurality of iron-zinc alloy coatings gradually decreasing or increasing, within the range of from 5 to 98 wt.%, from the innermost coating toward the outermost coating of said plurality of iron-zinc alloy coatings, and the total coating weight of said plurality of iron-zinc alloy coatings being within the range of from 5 to 50 g/m$^2$ per side of said steel sheet (hereinafter referred to as the "prior art 2").

The above-mentioned prior art 2 involves, as in the prior art 1, the following problems:

(1) When applying a severe forming such as that by a press, powdering may be caused in the plurality of iron-zinc alloy coatings.

(2) A considerable difference in the ratio of zinc content to the coating weight between two adjacent coatings among the plurality of iron-zinc alloy coatings leads to a large difference in the electrode potential between the above-mentioned two adjacent coatings, and this causes galvanic corrosion in the iron-zinc alloy coatings, thus deteriorating bare corrosion resistance of the iron-zinc alloy coating itself and corrosion resistance after painting.

Under such circumstances, there is a strong demand for the development of an iron-zinc alloy electro-galvanized steel sheet excellent in bare corrosion resistance of the iron-zinc alloy coating itself and corrosion resistance after painting, which is not susceptible to powdering in the iron-zinc alloy coating even through a severe forming such as that by a press, but an iron-zinc alloy electro-galvanized steel sheet provided with such characteristics has not as yet been proposed.

SUMMARY OF THE INVENTION

An object of the present invention is therefore to provide an iron-zinc alloy electro-galvanized steel sheet excellent in bare corrosion resistance of the iron-zinc alloy coating itself and corrosion resistance after painting, which is not susceptible to powdering in the iron-zinc alloy coating even after a severe forming such as that by a press.

In accordance with one of the features of the present invention, there is provided an iron-zinc alloy electro-galvanized steel sheet having a plurality of iron-zinc alloy coatings, which comprises:

at least one iron-zinc alloy coating as the lower layer, formed on at least one surface of a steel sheet; and at least one iron-zinc alloy coating as the upper layer, formed on said at least one iron-zinc alloy coating as the lower layer, the ratio of iron content to the coating weight of each of said at least one iron-zinc alloy coating as the upper layer being higher than the ratio of iron content to the coating weight of each of said at least one iron-zinc alloy coating as the lower layer;

the ratio of iron content to the coating weight of each of said at least one iron-zinc alloy coating as the lower layer being within the range of from 1 to 15 wt.%, and the total coating weight of said at least one iron-zinc alloy coating as the lower layer being within the range of from 1 to 50 g/m$^2$ per side of said steel sheet;

said at least one iron-zinc alloy coating as the upper layer comprising at least two iron-zinc alloy coatings, the ratio of iron content to the coating weight of each of said at least two iron-zinc alloy coatings as the upper layer being over 15 wt.%, the ratio of iron content to the coating weight gradually increasing from the innermost coating toward the outermost coating of said at least two iron-zinc alloy coatings as the upper layer, the difference in the ratio of iron content to the coating weight between two adjacent coatings of said at least two iron-zinc alloy coatings as the upper layer being within the range of from 1 to 15 wt.%, and the total coating weight of said at least two iron-zinc alloy coatings as the upper layer being within the range of from 1 to 40 g/m$^2$ per side of said steel sheet;

the difference in the ratio of iron content to the coating weight between the uppermost coating of said at least one iron-zinc alloy coating as the lower layer and the lowermost coating of said at least two iron-zinc alloy coatings as the upper layer being within the range of from 1 to 15 wt.%; and the sum of said total coating weight of said at least one iron-zinc alloy coating as the lower layer and said total coating weight of said at least two iron-zinc alloy coatings as the upper layer being within the range of from 10 to 75 g/m$^2$ per side of said steel sheet.

DETAILED DESCRIPTION OF PREFERRED EMBODIMENTS

Figure 1:
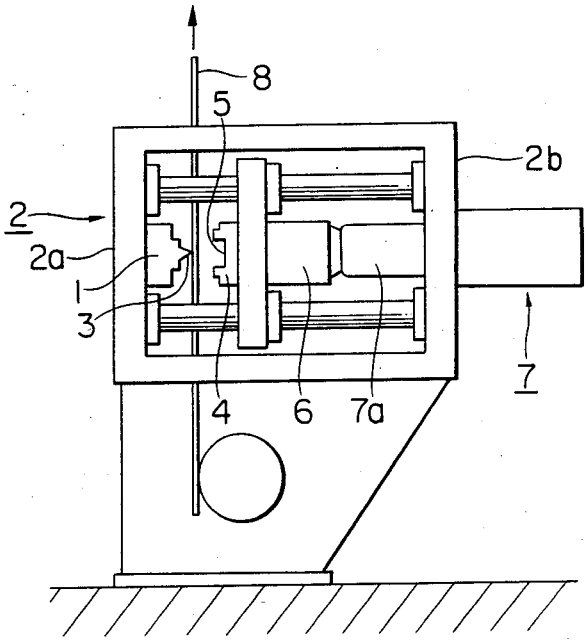
FIG. 1 is a schematic front view illustrating a draw-bead tester for testing the property withstanding powdering (hereinafter referred to as the "powdering resistance") of an iron-zinc alloy coating (hereinafter referred to as the "Fe-Zn alloy coating") of an iron-zinc alloy electro-galvanized steel sheet.

With a view to solving the above-mentioned problems involved in the conventional iron-zinc alloy electro-galvanized steel sheets and developing an iron-zinc alloy electro-galvanized steel sheet excellent in bare corrosion resistance of the iron-zinc alloy coating (hereinafter referred to as the "Fe-Zn alloy coating") itself and corrosion resistance after painting, which is not susceptibel to powdering in the Fe-Zn alloy coating even through a severe forming such as that by a press, we conducted extensive studies. First, we investigated the relationship between the property of withstanding powdering (hereinafter referred to as the "powdering resistance") of an Fe-Zn alloy coating and the ratio of iron content to the coating weight under application of severe forming such as that by a press, to an iron-zinc alloy electro-galvanized steel sheet, by means of a draw-bead tester simulating the above-mentioned forming, as follows:

FIG. 1 is a schematic front view illustrating a draw-bead tester. The draw-bead tester comprises, as shown in FIG. 1, a male die 1, having a horizontal projection 3 of a prescribed length, fixed to a side 2*a* of a box-like frame 2, a female die 4, having a horizontal groove 5 of a prescribed length, facing the projection 3 of the male die 1, and a hydraulic cylinder 7, secured to the other side 2*b* of the frame 2, for supporting the female die 4 and horizontally moving the female die 4 toward the projection 3 of the male die 1. The female die 4 is secured through a load cell 6 to a rod 7*a* of the hydraulic cylinder 7.

A test piece 8 cut from an iron-zinc alloy electro-galvanized steel sheet having a Fe-Zn alloy coating was vertically inserted into the gap between the projection 3 of the male die 1 and the groove 5 of the female die 4, with the Fe-Zn alloy coating faced the projection 3 of the male die 1, and the hydraulic cylinder 7 was actuated to press the test piece 8 under a pressure of 63 kg/cm$^2$ by means of the projection 3 of the male die 1 and the groove 5 of the female die 4. Then the test piece 8 was squeezed by pulling it upward in the arrow direction to see the amount of the Fe-Zn alloy coating peeled off. This test was applied to a plurality of test pieces 8 having different ratios of iron content to the coating weight within the range of from 4 to 30 wt.% and a total coating weight of Fe-Zn alloy coating of 40 kg/m$^2$ per side of the test piece.

Figure 2:
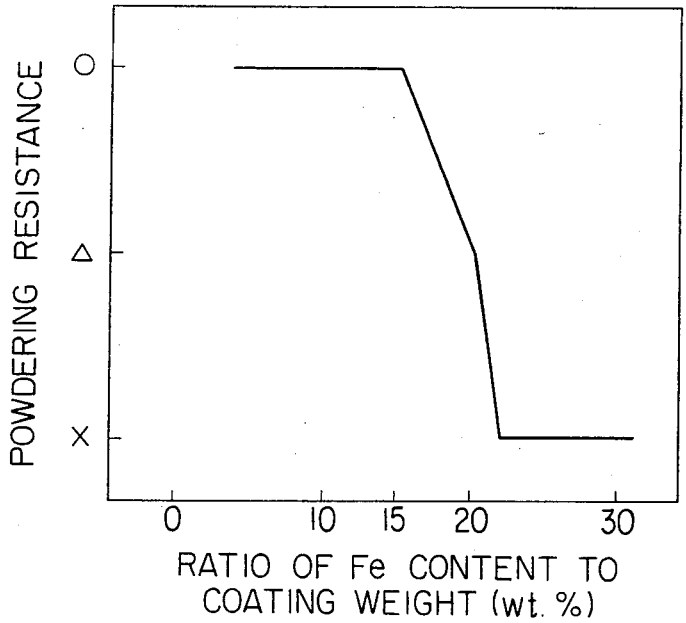
FIG. 2 is a graph illustrating results of test of powdering resistance of the Fe-Zn alloy coating tested by the draw-bead tester shown in FIG. 1.

FIG. 2 is a graph illustrating the results of test of powdering resistance of the Fe-Zn alloy coating carried out by the above-mentioned method. In FIG. 2, the abscissa represents the ratio of iron content to the coating weight of the Fe-Zn alloy coating, and the ordinate indicates powdering resistance of the Fe-Zn alloy coating. Powdering resistance was evaluated with the following criteria:

- ○ :the weight of peeled Fe-Zn alloy coating is under 0.5 g/m$^2$ per side of the test piece;
- Δ:the weight of peeled Fe-Zn alloy coating is within the range of from 0.5 to 2.0 g/m$^2$ per side of the test piece;
- ×:the weight of peeled Fe-Zn alloy coating is over 2.0 g/m$^2$ per side of the test piece.

As a result of the above-mentioned test, it was found, as shown in FIG. 2, that a ratio of iron content to the coating weight of the Fe-Zn alloy coating of up to 15 wt.% leads to a satisfactory powdering resistance, whereas a ratio of iron content to the coating weight of the Fe-Zn alloy coating of over 15 wt.% results in a sharp deterioration of powdering resistance.

The reason why powdering resistance is thus sharply deteriorated with a ratio of iron content to the coating weight of the Fe-Zn alloy coating of over 15 wt.% is as follows. An Fe-Zn alloy coating having a ratio of iron content to the coating weight of over 15 wt.% has a high internal tensile stress caused by electro-galvanizing. When forming an iron-zinc alloy electro-galvanized steel sheet having such an Fe-Zn alloy coating, therefore, a shearing force is produced on the interface between the steel sheet and the Fe-Zn alloy coating, and this shearing force causes powdering of the Fe-Zn alloy coating.

According to our study, on the other hand, with a ratio of iron content to the coating weight of the Fe-Zn alloy coating of over 15 wt.%, bare corrosion resistance of the Fe-Zn alloy coating itself is increased, whereas corrosion resistance after painting of the iron-zinc alloy electro-galvanized steel sheet is deteriorated.

We obtained the following finding from these facts. An iron-zinc alloy electro-galvanized steel sheet excellent in powdering resistance, bare corrosion resistance of the Fe-Zn alloy coating itself and corrosion resistance after painting can be obtained, which comprises at least one Fe-Zn alloy coating as the lower layer formed on at least one surface of a steel sheet and at least two Fe-Zn alloy coatings as the upper layer formed on said at least one Fe-Zn alloy coating as the lower layer, by limiting the ratio of iron content to the coating weight of each of said at least one Fe-Zn alloy coating as the lower layer within the range of from 1 to 15 wt.%; limiting the ratio of iron content to the coating weight of each of said at least two Fe-Zn alloy coatings as the upper layer to over 15 wt.%; gradually increasing the ratio of iron content to the coating weight from the innermost coating toward the outermost coating of said at least two Fe-Zn alloy coatings as the upper layer; and the difference in the ratio of iron content to the coating weight between two adjacent coatings of said at least two Fe-Zn alloy coatings as the upper layer and the difference in the ratio of iron content to the coating weight betwen the uppermost coating of said at least one Fe-Zn alloy coating as the lower layer and the lowermost coating of said at least two Fe-Zn alloy coating as the upper layer within the range of from 1 to 15 wt.%.

The reason why an excellent powdering resistance is available by forming Fe-Zn alloy coatings of the iron-zinc alloy electro-galvanized steel sheet as mentioned above is as follows. Since the ratio of iron content to the coating weight of each of the at least one Fe-Zn alloy coating as the lower layer formed on at least one surface of the steel sheet is within the range of from 1 to 15 wt.%, the at least one Fe-Zn alloy coating as the lower layer has a low internal tensile stress, and there is a high adherence between the lowermost coating of the at least one Fe-Zn alloy coating as the lower layer and the steel sheet. Therefore, even when applying a severe forming such as that by a press to the steel sheet, almost no shearing force is generated on the interface between the lowermost coating of the at least one Fe-Zn alloy coating as the lower layer and the steel sheet. On the other hand, since the Fe-Zn alloy coatings show a substantially identical elongation irrespective of the ratio of iron content to the coating weight, the at least one Fe-Zn alloy coating as the lower layer and the at least two Fe-Zn alloy coatings as the upper layer are deformed as an integral entirety when forming is applied. Therefore, even when applying a severe forming such as that by a press, powdering of the Fe-Zn alloy coating never occurs.

The ratio of iron content to the coating weight of each of the at least one Fe-Zn alloy coating as the lower layer should be within the range of from 1 to 15 wt.%. When the ratio of iron content to the coating weight of each of the at least one Fe-Zn alloy coating as the lower layer is under 1 wt.%, it is impossible to obtain a desired corrosion resistance after painting. On the other hand, when the ratio of iron content to the coating weight of each of the at least one Fe-Zn alloy coating as the lower layer is over 15 wt.%, the internal tensile stress of each of the at least one Fe-Zn alloy coating as the lower layer becomes higher, thus deteriorating powdering resistance.

The total coating weight of the at least one Fe-Zn alloy coating as the lower layer should be within the range of from 1 to 50 g/m$^2$ per side of the steel sheet. When the total coating weight of the at least one Fe-Zn alloy coating as the lower layer is under 1 g/m$^2$ per side of the steel sheet, adherence between the lowermost coating of the at least one Fe-Zn alloy coating as the lower layer and the steel sheet decreases, because such a small coating weight can not fully cover the entire surface of the steel sheet, thus deteriorating powdering resistance. On the other hand, when the total coating weight of the at least one Fe-Zn alloy coating as the lower layer is over 50 g/m$^2$ per side of the steel sheet, the internal tensile stress acting on the interface between the lowermost coating of the at least one Fe-Zn alloy coating as the lower layer and the steel sheet becomes larger, thus also deteriorating powdering resistance.

The ratio of iron content to the coating weight of each of the at least two Fe-Zn alloy coatings as the upper layer should be over 15 wt.%. When the ratio of iron content to the coating weight of each of the at least two Fe-Zn alloy coatings as the upper layer is up to 15 wt.%, it is impossible to obtain a desired corrosion resistance after painting.

The ratio of iron content to the coating weight should be gradually increased from the innermost coating toward the outermost coating of the at least two Fe-Zn alloy coating as the upper layer, and the difference in the ratio of iron content to the coating weight between two adjacent coatings of the at least two Fe-Zn alloy coatings as the upper layer should be within the range of from 1 to 15 wt.%.

The reason why the ratio of iron content to the coating weight should be gradually increased from the innermost coating toward the outermost coating of the at least two Fe-Zn alloy coatings as the upper layer is as follows. As mentioned hereinafter, the ratio of iron content to the coating weight of the uppermost coating of the at least two Fe-Zn alloy coatings as the upper layer should preferably be at least 50 wt.% in order to prevent crater-like pinholes from occurring in a paint film when forming the paint film through cationic type electro-deposition on the surface of the uppermost Fe-Zn alloy coating.

When the difference in the ratio of iron content to the coating weight between two adjacent coatings of the at least two Fe-Zn alloy coatings as the upper layer is under 1 wt.%, it is impossible to obtain a desired corrosion resistance after painting. On the other hand, if the difference in the ratio of iron content to the coating weight between two adjacent coatings is over 15 wt.%, the difference in electrode potential between said two adjacent coatings becomes larger, thus causing galvanic corrosion in said two adjacent coatings, and hence deteriorating bare corrosion resistance of the Fe-Zn alloy coating itself and corrosion resistance after painting.

The above-mentioned definition of the difference in the ratio of iron content to the coating weight between two adjacent coatings of the at least two Fe-Zn alloy coatings as the upper layer within the range of from 1 to 15 wt. % is one of the important requirements in the present invention. By defining the difference in the ratio of iron content to the coating weight between two adjacent coatings within the range of from 1 to 15 wt. %, the following effects are available:

(1) Since difference in electrode potential between two adjacent coatings of the at least two Fe-Zn alloy coatings as the upper layer is small, galvanic corrosion never occurs in said two adjacent coatings.

(2) It is possible to increase the ratio of iron content to the coating weight of the uppermost coating of the at least two Fe-Zn alloy coatings as the upper layer without causing galvanic corrosion in two adjacent coatings, and consequently, it is possible to obtain an iron-zinc alloy electro-galvanized steel sheet excellent not only in corrosion resistance after painting, but also in water-resistant paint adhesivity of the paint film described later and appearance of the paint film surface.

(3) Even by applying a severe forming to the iron-zinc alloy electro-galvanized steel sheet, no peeloff occurs on the interface between two adjacent coatings of the at least two Fe-Zn alloy coatings as the upper layer.

(4) Even when a breakage occurs in the uppermost coating of the at least two Fe-Zn alloy coatings as the upper layer in the application of a severe forming to the iron-zinc alloy electro-galvanized steel sheet, it is possible to prevent corrosion resistance after painting from decreasing by the presence of the Fe-Zn alloy coating having a chemical composition similar to that of the above-mentioned uppermost coating, which is directly under the uppermost coating.

The total coating weight of the at least two Fe-Zn alloy coatings as the upper layer should be within the range of from 1 to 40 g/m$^2$ per side of the steel sheet. A total coating weight of the at least two Fe-Zn alloy coatings as the upper layer of under 1 g/m$^2$ per side of the steel sheet cannot give a desired corrosion resistance after painting, such a small coating weight can not fully cover the entire surface of the uppermost coating of the at least one Fe-Zn alloy coating as the lower layer. If, on the other hand, the total coating weight of the at least two Fe-Zn alloy coatings as the upper layer is over 40 g/m$^2$ per side of the steel sheet, the internal tensile stress acting on the interface between the lowermost coating of the at least two Fe-Zn alloy coatings as the upper layer and the uppermost coating of the at least one Fe-Zn alloy coating as the lower layer becomes larger, thus deteriorating powdering resistance.

The difference in the ratio of iron content to the coating weight between the uppermost coating of the at least one Fe-Zn alloy coating as the lower layer and the lowermost coating of the at least two Fe-Zn alloy coatings as the upper layer should be within the range of from 1 to 15 wt. %. If the difference in the ratio of iron content to the coating weight between the uppermost coating of the at least one Fe-Zn alloy coating as the lower layer and the lowermost coating of the at least two Fe-Zn alloy coatings as the upper layer is under 1 wt. %, a desired corrosion resistance after painting cannot be obtained. If the above-mentioned difference in the ratio of iron content to the coating weight is over 15 wt. %, on the other hand, the difference in electrode potential between the uppermost coating of the at least one Fe-Zn alloy coating as the lower layer and the lowermost coating of the at least two Fe-Zn alloy coatings as the upper layer becomes larger, thus causing galvanic corrosion in the both Fe-Zn alloy coatings and consequently deteriorating bare corrosion resistance of the Fe-Zn alloy coating itself and corrosion resistance after painting.

The definition of the difference in the ratio of iron content to the coating weight between the uppermost coating of the at least one Fe-Zn alloy coating as the lower layer and the lowermost coating of the at least two Fe-Zn alloy coatings as the upper layer within the range of from 1 to 15 wt. % is one of the important requirements in the present invention. By defining the difference in the ratio of iron content to the coating weight within the range of from 1 to 15 wt. %, it is possible to obtain the same effects as those available by defining the difference in the ratio of iron content to the coating weight between two adjacent Fe-Zn alloy coatings of the at least two Fe-Zn alloy coatings as the upper layer within the range of from 1 to 15 wt. % as mentioned previously.

The sum of the total coating weight of the at least one Fe-Zn alloy coating as the lower layer and the total coating weight of the at least two Fe-Zn alloy coatings as the upper layer should be within the range of from 10 to 75 g/m$^2$ per side of the steel sheet. If the sum of the total coating weight of the at least one Fe-Zn alloy coating as the lower layer and the total coating weight of the at least two Fe-Zn alloy coatings as the upper layer is under 10 g/m$^2$ per side of the steel sheet, a desired corrosion resistance after painting cannot be obtained. If, on the other hand, the above-mentioned sum is over 75 g/m$^2$ per side of the steel sheet, the internal tenside stress acting on the interface between the steel sheet and the lowermost coating of the at least one Fe-Zn alloy coating as the lower layer becomes larger, thus deteriorating powdering resistance.

When the at least one Fe-Zn alloy coating as the lower layer comprises at least two Fe-Zn alloy coatings, two adjacent coatings of the at least two Fe-Zn alloy coatings as the lower layer should be different from each other in the ratio of iron content to the coating weight by a value within the range of from 1 to 14 wt. %. If the difference in the ratio of iron content to the coating weight between two adjacent coatings of the at least two Fe-Zn alloy coatings as the lower layer is under 1 wt. %, a desired corrosion resistance after painting cannot be obtained. On the other hand, if the difference in the ratio of iron content to the coating weight between two adjacent Fe-Zn alloy coatings is over 14 wt. %, the ratio of iron content to the coating weight of at least one of the at least two Fe-Zn alloy coatings as the lower layer becomes over 15 wt. %, leading to a larger internal tenside stress in at least one of the at least two Fe-Zn alloy coatings as the lower layer, thus deteriorating powdering resistance.

The ratio of iron content to the coating weight of the uppermost coating of the at least two Fe-Zn alloy coatings as the upper layer should preferably be at least 50 wt. %. When the ratio of iron content to the coating weight of the uppermost Fe-Zn alloy coating is at least 50 wt. %, crater-like pinholes are never produced in a paint film when forming the paint film through cationic type electro-deposition on the surface of the uppermost Fe-Zn alloy coating, and there is available a painting film excellent in water-resistant paint adhesivity and appearance of the paint film surface. As far as the above-mentioned requirements in the present invention are satisfied, the ratio of iron content to the coating weight of the uppermost coating of the at least two Fe-Zn alloy coatings as the upper layer may be 100 wt. %.

In the above-mentioned construction of the iron-zinc alloy electro-galvanized steel sheet of the present invention, the definition of the difference in the ratio of iron content to the coating weight between two adjacent coatings of the at least two Fe-Zn alloy coatings as the upper layer within the range of from 1 to 15 wt. %, and the definition of the difference in the ratio of iron content to the coating weight between the uppermost coating of the at least one Fe-Zn alloy coating as the lower layer and the lowermost coating of the at least two Fe-Zn alloy coatings as the upper layer within the range of from 1 to 15 wt. % are points particularly different from the prior art 1 and the prior art 2. By defining the difference in the ratio of iron content to the coating weight between two adjacent Fe-Zn alloy coatings within the range of from 1 to 15 wt. % as mentioned above, no galvanic corrosion occurs in the two adjacent Fe-Zn alloy coatings, and no peeloff occurs on the interface between the two adjacent Fe-Zn alloy coatings. By the definition of the ratio of iron content to the coating weight of each of the at least one Fe-Zn alloy coating as the lower layer within the range of from 1 to 15 wt. %, and the definition of the ratio of iron content to the coating weight of each of the two Fe-Zn alloy coatings as the upper layer to over 15 wt. %, which are typical differences from the prior art 1 and the prior art 2, it is possible to obtain an iron-zinc alloy electro-galvanized steel sheet excellent in powdering resistance, bare corrosion resistance of the Fe-Zn alloy coating itself and corrosion resistance after painting.

The iron-zinc alloy electro-galvanized steel sheet of the present invention having Fe-Zn alloy coatings as mentioned above can be easily manufactured by forming a plurality of Fe-Zn alloy coatings on the steel sheet surface by altering such gavanizing conditions as the chemical composition of the galvanizing solution, pH, temperature and flow velocity of the galvanizing solution, and the galvanizing current density.

FIG. 3(A), FIG. 3(B), FIG. 3(C), FIG. 3(D) and FIG. 3(E) are descriptive views illustrating embodiments of the iron-zinc alloy electro-galvanized steel sheet of the present invention. In FIGS. 3(A) to 3(E), "a" represents the lower layer, and "b", the upper layer.

Figure 3A:
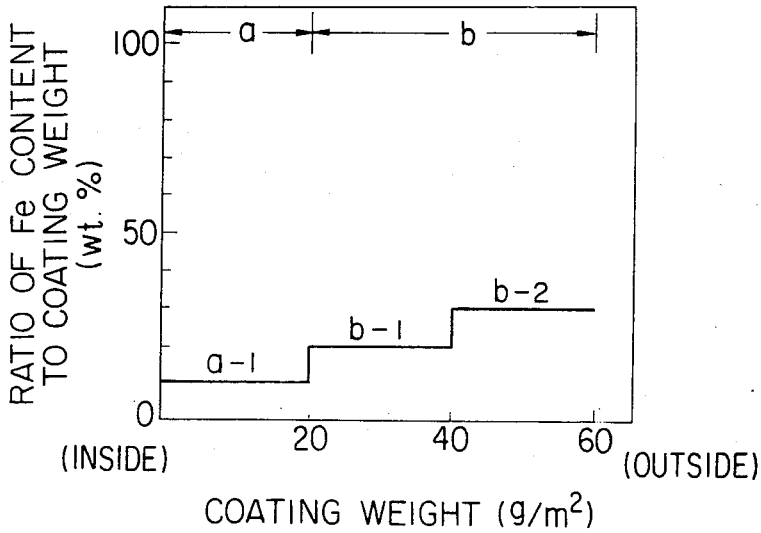
FIG. 3(A) is a descriptive view illustrating the first embodiment of the iron-zinc alloy electro-gavanized steel sheet of the present invention, which comprises an Fe-Zn alloy coating as the lower layer and two Fe-Zn alloy coatings as the upper layer, the ratio of iron content to the coating weight increasing, at a constant rate, from the innermost Fe-Zn alloy coating as the lower layer toward the outermost coating of the two Fe-Zn alloy coatings as the upper layer.
Figure 3B:
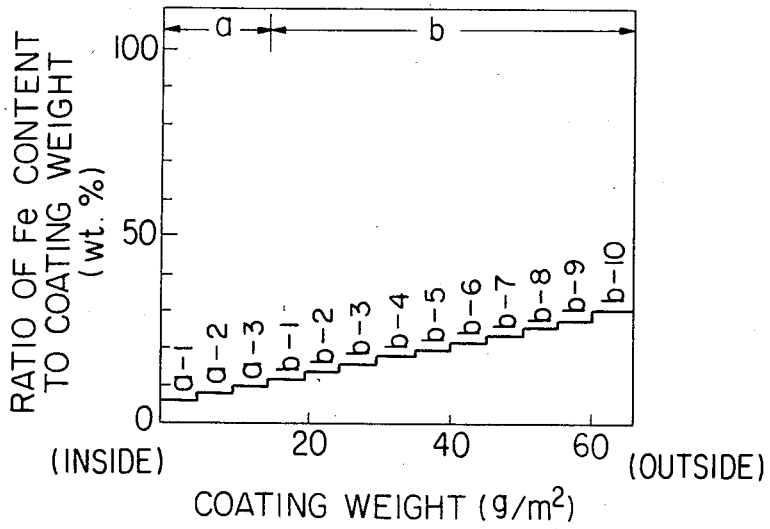
FIG. 3(B) is a descriptive view illustrating the second embodiment of the iron-zinc alloy electro-galvanized steel sheet of the present invention, which comprises three Fe-Zn alloy coatings as the lower layer and ten Fe-Zn alloy coatings as the upper layer, the ratio of iron content to the coating weight increasing, at a constant rate, from the innermost coating of the three Fe-Zn alloy coatings as the lower layer toward the outermost coating of the ten Fe-Zn alloy coatings as the upper layer.

The iron-zinc alloy electro-galvanized steel sheet of the first embodiment of the present invention shown in FIG. 3(A) comprises an Fe-Zn alloy coating a-1 as the lower layer "a" and two Fe-Zn alloy coatings b-1 and b-2 as the upper layer "b", and the ratio of iron content to the coating weight of each of the Fe-Zn alloy coatings of the lower layer "a" and the upper layer "b" increases from the innermost Fe-Zn alloy coating a-1 as the lower layer "a" toward the outermost Fe-Zn alloy coating b-2 of the two Fe-Zn coatings as the upper layer "b" at a rate of 10 wt. %.

The iron-zinc alloy electro-galvanized steel sheet of the second embodiment of the present invention shown in Fig. (B) comprises three Fe-Zn alloy coatings a-1 to a-3 as the lower layer "a" and ten Fe-Zn alloy coatings b-1 to b-10 as the upper layer "b", and the ratio of iron content to the coating weight of each of the Fe-Zn alloy coatings of the lower layer "a" and the upper layer "b" increases from the innermost coating a-1 of the three Fe-Zn alloy coatings as the lower layer "a" toward the outermost coating b-10 of the ten Fe-Zn alloy coatings as the upper layer "b" at a rate of 2 wt. %.

Figure 3C:
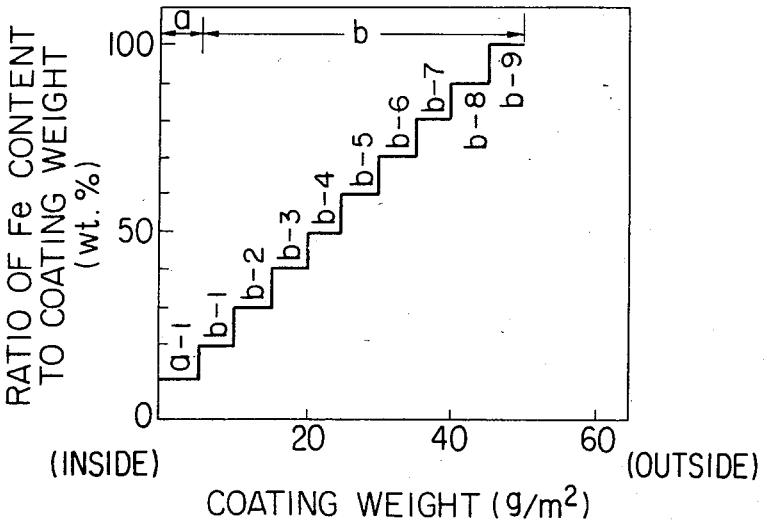
FIG. 3(C) is a descriptive view illustrating the third embodiment of the iron-zinc alloy electro-galvanized steel sheet of the present invention, which comprises an Fe-Zn alloy coating as the upper layer and nine Fe-Zn alloy coatings as the upper layer, the ratio of iron content to the coating weight increasing, at a constant rate, from the innermost Fe-Zn alloy coating as the lower layer toward the outermost coating of the nine Fe-Zn alloy coatings as the upper layer.

The iron-zinc alloy electro-galvanized steel sheet of the third embodiment of the present invention shown in FIG. 3(C) comprises an Fe-Zn alloy coating a-1 as the lower layer "a" and nine Fe-Zn alloy coatings b-1 to b-9 as the upper layer "b", and the ratio of iron content to the coating weight of each of the Fe-Zn alloy coatings as the lower layer "a" and the upper layer "b" increases from the innermost Fe-Zn alloy coating a-1 as the lower layer "a" toward the outermost coating b-9 of the nine Fe-Zn alloy coatings as the upper layer "b" at a rate of 10 wt. %, the uppermost layer b-9 having a ratio of iron content to the coating weight of 100 wt. %.

Figure 3D:
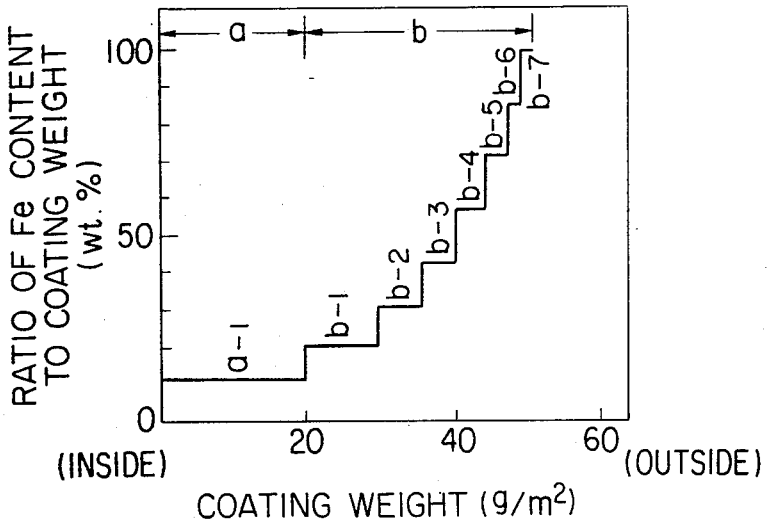
FIG. 3(D) is a descriptive view illustrating the forth embodiment of the iron-zinc alloy electro-galvanized steel sheet of the present invention, which comprises an Fe-Zn alloy coating as the lower layer and seven Fe-Zn alloy coatings as the upper layer, the ratio of iron content to the coating weight increasing, at an increasing rate, from the innermost Fe-Zn alloy coating as the lower layer toward the outermost coating of the seven Fe-Zn alloy coatings as the upper layer.

The iron-zinc alloy electro-galvanized steel sheet of the fourth embodiment of the present invention shown in FIG. 3(D) comprises an Fe-Zn alloy coating a-1 as the lower layer "a" and seven Fe-Zn alloy coatings b-1 to b-7 as the upper layer "b", and the ratio of iron content to the coating weight of each of the Fe-Zn alloy coatings of the lower layer "a" and the upper layer "b" increases from the innermost Fe-Zn alloy coating a-1 as the lower layer "a" toward the outermost coating b-7 of the seven Fe-Zn coatings as the upper layer "b" at a rate increasing in this direction, the ratio of iron content to the coating weight of the outermost coating b-7 being 100 wt. %.

Figure 3E:
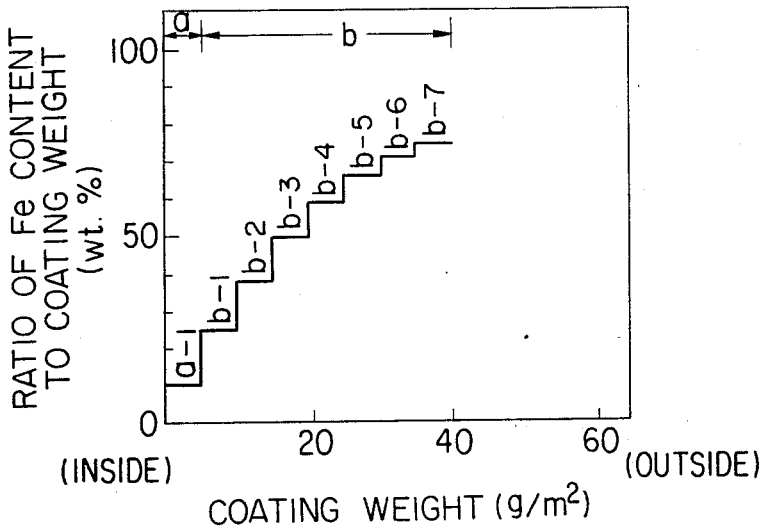
FIG. 3(E) is a descriptive view illustrating the fifth embodiment of the iron-zinc alloy electro-galvanized steel sheet of the present invention, which comprises an Fe-Zn alloy coating as the lower layer and seven Fe-Zn alloy coatings as the upper layer, the ratio of iron content to the coating weight increasing, at a decreasing rate, from the innermost Fe-Zn alloy coating as the lower layer toward the outermost coating of the seven Fe-Zn alloy coatings as the upper layer.

The iron-zinc alloy electro-galvanized steel sheet of the fifth embodiment of the present invention shown in FIG. 3(E) comprises an Fe-Zn alloy coating a-1 as the lower layer "a" and seven Fe-Zn alloy coatings b-1 to b-7 as the upper layer "b", and the ratio of iron content to the coating weight of each of the Fe-Zn alloy coatings of the lower layer "a" and the upper layer "b" increases from the innermost Fe-Zn alloy coating a-1 as the lower layer "a" toward the outermost coating b-7 of the seven Fe-Zn alloy coatings as the upper layer "b" at a rate decreasing in this direction.

Now, the iron-zinc alloy electro-galvanized steel sheet of the present invention is described in detail by means of examples while comparing with reference cases.

EXAMPLE 1

Steel sheets were subjected to an electro-galvanizing treatment under the following conditions:

(1) Chemical composition of the galvanizing bath used:
Zinc sulfate ($ZnSO_4.7H_2O$): from 45 to 315 g/l,
Iron sulfate ($FeSO_4.7H_2O$): from 135 to 405 g/l,
Sodium sulfate ($Na_2SO_4$): 30 g/l,
Sodium acetate ($CH_3COONa.3H_2O$): 20 g/l,
Citric acid ($C_6H_8O_7$): 5 g/l, (2) Galvanizing conditions:
pH of galvanizing bath: from 2.8 to 3.0,
Galvanizing current density: from 30 to 50 A/dm$^2$,
Temperature of galvanizing bath: 50° C.,
Flow velocity of galvanizing bath: 1 m/sec, to prepare samples of the iron-zinc alloy electro-galvanized steel sheet of the present invention (hereinafter referred to as the "samples of the present invention") Nos. 1 to 12 having Fe-Zn alloy coatings within the scope of the present invention shown in Table 1, and samples of the iron-zinc alloy electro-galvanized steel sheet for reference (hereinafter referred to as the "reference samples") Nos. 1 to 11 having Fe-Zn alloy coatings outside the scope of the present invention also shown in Table 1.

When preparing the samples of the present invention Nos. 1 to 12 and the reference samples Nos. 1 to 11, the ratio of iron content to the coating weight of the Fe-Zn alloy coatings was altered by changing at least one of the galvanizing current density and the ratio of the quantity of iron sulfate to the total quantity of iron sulfate and zinc sulfate of the galvanizing bath $$\left(\frac{FeSO_4.7H_2O}{FeSO_4.7H_2O + ZnSO_4.7H_2O} \times 100\right)$$

(hereinafter referred to as the "iron salt ratio"), and the coating weight was altered by changing the combination of the galvanizing current density and the galvanizing time.

For the thus prepared samples of the present invention Nos. 1 to 12 and the thus prepared reference samples Nos. 1 to 11, powdering resistance, corrosion resistance after painting of the non-formed sheet, corrosion resistance after painting of the formed sheet, water-resistant paint adhesivity and appearance of the paint film surface were evaluated by the following performance tests, and the results are shown also in Table 1.

TABLE 1

| | Fe—Zn alloy coating | | | | | | | | | | | | Test results | | | | |
|---|---|---|---|---|---|---|---|---|---|---|---|---|---|---|---|---|---|
| | Lower layer | | Upper layer | | | | | | | | | | | | | | |
| | No. 1 | | No. 1 | | No. 2 | | No. 3 | | No. 4 | | No. 5 | | | | | | |
| | Coating weight ($g/m^2$) | Ratio of Fe content (wt. %) | Coating weight ($g/m^2$) | Ratio of Fe content (wt. %) | Coating weight ($g/m^2$) | Ratio of Fe content (wt. %) | Coating weight ($g/m^2$) | Ratio of Fe content (wt. %) | Coating weight ($g/m^2$) | Ratio of Fe content (wt. %) | Coating weight ($g/m^2$) | Ratio of Fe content (wt. %) | Powdering resistance | Corrosion resistance after painting of nonformed sheet | Corrosion resistance after painting of formed sheet | Water-resistant paint adhesivity | Appearance of paint film surface |
| No. of sample of the present invention | | | | | | | | | | | | | | | | | |
| 1 | 3 | 12 | 10 | 21 | 10 | 34 | — | — | — | — | — | — | o | o | o | x | x |
| 2 | 10 | 12 | 20 | 21 | 10 | 34 | — | — | — | — | — | — | o | o | o | x | x |
| 3 | 20 | 12 | 10 | 21 | 10 | 34 | — | — | — | — | — | — | o | o | o | x | x |
| 4 | 40 | 12 | 10 | 21 | 5 | 34 | — | — | — | — | — | — | o | o | o | x | x |
| 5 | 10 | 6 | 10 | 17 | 10 | 30 | — | — | — | — | — | — | o | o | o | x | x |
| 6 | 10 | 13 | 10 | 21 | 10 | 35 | 5 | 42 | — | — | — | — | o | o | o | x | x |
| 7 | 30 | 13 | 10 | 21 | 10 | 35 | 5 | 42 | — | — | — | — | o | o | o | x | x |
| 8 | 10 | 13 | 10 | 21 | 10 | 35 | 5 | 50 | — | — | — | — | o | o | o | o | o |
| 9 | 10 | 14 | 10 | 29 | 5 | 44 | 5 | 59 | — | — | — | — | o | o | o | o | o |
| 10 | 10 | 13 | 10 | 27 | 5 | 42 | 5 | 56 | 5 | 70 | — | — | o | o | o | o | o |
| 11 | 10 | 13 | 10 | 27 | 5 | 42 | 5 | 56 | 5 | 70 | 5 | 85 | o | o | o | o | o |
| 12 | 30 | 13 | 10 | 27 | 5 | 42 | 5 | 56 | 5 | 70 | 5 | 85 | o | o | o | o | o |
| No. of reference sample | | | | | | | | | | | | | | | | | |
| 1 | 40 | 10 | — | — | — | — | — | — | — | — | — | — | o | x | — | — | — |
| 2 | 40 | 25 | — | — | — | — | — | — | — | — | — | — | x | o | — | — | — |
| 3 | 20 | 8 | 20 | 21 | — | — | — | — | — | — | — | — | o | o | Δ | x | x |
| 4 | 60 | 12 | 10 | 21 | 5 | 34 | — | — | — | — | — | — | x | o | Δ | x | x |
| 5 | 10 | 12 | 20 | 21 | 25 | 34 | — | — | — | — | — | — | x | o | Δ | x | x |
| 6 | 10 | 12 | 25 | 21 | 20 | 34 | — | — | — | — | — | — | x | o | Δ | x | x |
| 7 | 10 | 6 | 10 | 17 | 10 | 34 | — | — | — | — | — | — | o | Δ | Δ | x | x |
| 8 | 10 | 3 | 10 | 21 | 5 | 40 | — | — | — | — | — | — | o | Δ | Δ | x | x |
| 9 | 20 | 20 | 10 | 27 | 10 | 42 | — | — | — | — | — | — | x | o | Δ | x | x |
| 10 | 2 | 13 | 2 | 27 | 4 | 42 | — | — | — | — | — | — | o | x | x | x | x |
| 11 | 50 | 13 | 10 | 27 | 10 | 42 | 10 | 56 | 5 | 70 | 5 | 85 | x | o | Δ | o | o |

(1) Powdering resistance test:

The amount of peeloff of the Fe-Zn alloy coating from the sample was measured by squeezing the sample by means of the draw-bead tester shown in FIG. 1 to evaluate the degree of powdering resistance from said amount of peeloff of Fe-Zn alloy coating. The criteria of evaluation are as described above.

(2) Test on corrosion resistance after painting of the non-formed sheet:

A sample not applied with forming was subject to an immersion type phosphating treatment using phosphating solution (BT 3030) made by Nihon Parkerizing Co., Ltd. to form a phosphate film on the sample surface, then subjected to a cationic type electro-deposition to form a 20 μm thick paint film on the phosphate film, and then a cross notch was cut on the thus formed paint film. On the resultant sample having the cross notch, the maximum blister width of the paint film was measured on one side of the cross notch after the lapse of 1,000 hours in the salt spray test as set forth in JIS 2371, and corrosion resistance after painting of the non-formed sheet was evaluated on the basis of the maximum blister width of the paint film. The criteria of evaluation are as follows:

○: The maximum blister width of paint film is under 3 mm;

Δ: The maximum blister width of paint film is from 3 mm to under 5 mm;

×: The maximum blister width of paint film is 5 mm or over.

(3) Test on corrosion resistance after painting of the formed sheet:

A sample was squeezed by means of the draw-bead tester shown in FIG. 1. The thus squeezed sample was subjected to the same phosphating treatment and electro-deposition treatment as in (2) above, and then corrosion resistance after painting of the formed sheet was evaluated in the same manner as in (2) above.

(4) Water-resistant paint adhesivity test:

A sample not applied with forming was subjected to an immersion type phosphating treatment using phosphating solution (BT 3030) made by Nihon Parkerizing Co., Ltd. to form a phosphate film on the sample surface, then subjected to a cationic type electro-deposition to form a 20 μm thick paint film on the phosphate film, and then a 35 μm thick intermediate paint film and a 35 μm thick upper paint film were applied. The resultant sample having three paint films was immersed in pure water at a temperature of 40° C. for 240 hours, then 100 checkers notches were cut at intervals of 2 mm, an adhesive tape was pasted onto the paint film having these checkers notches and then the adhesive tape was stripped off. The state of peeloff of the paint film was inventigated, and the water-resistant paint adhesivity of the paint film was evaluated from the state of peeloff of the paint film. The criteria of evaluation are as follows:

○: No peeloff of the paint film occurs;

×: Peeloff of the paint film occurs.

(5) Test on appearance of the paint film surface:

A sample not applied with forming was subjected to an immersion type phosphating treatment using phosphating solution (BT 3030) made by Nihon Parkerizing Co., Ltd. to form a phosphate film on the sample surface, subjected to a cationic type electro-deposition to form a 20 μm thick paint film on the phosphate film. Occurrence of crater-like pinholes in the thus formed paint film was investigated, and appearence of the paint film surface was evaluated from the occurrence of the crater-like pinholes. The criteria of evaluation are as follows:

: almost no crater-like pinholes occur in the paint film;

×: crater-like pinholes occur in the paint film.

In Table 1, each of the samples of the present invention Nos. 1 to 5 comprises No. 1 Fe-Zn alloy coating as the lower layer and Nos. 1 and 2 Fe-Zn alloy coatings as the upper layer; each of the samples of the present invention Nos. 6 to 9 comprises No. 1 Fe-Zn alloy coating as the lower layer and Nos. 1 to 3 Fe-Zn alloy coatings as the upper layer; the sample of the present invention No. 10 comprises No. 1 Fe-Zn alloy coating as the lower layer and Nos. 1 to 4 Fe-Zn alloy coatings as the upper layer; and each of the samples of the present invention Nos. 11 and 12 comprises No. 1 Fe-Zn alloy coating as the lower layer and Nos. 1 to 5 Fe-Zn alloy coatings as the upper layer.

On the other hand, each of the reference samples Nos. 1 and 2 comprises a single Fe-Zn alloy coating; the reference sample No. 3 comprises No. 1 Fe-Zn alloy coating as the lower layer and No. 1 Fe-Zn alloy coating as the upper layer, each of the reference samples Nos. 4 to 10 comprises No. 1 Fe-Zn alloy coating as the lower layer and Nos. 1 and 2 Fe-Zn alloy coatings as the upper layer; and the reference sample No. 11 comprises No. 1 Fe-Zn alloy coating as the lower layer and Nos. 1 to 5 Fe-Zn alloy coatings as the upper layer.

In the reference sample No. 4, however, No. 1 Fe-Zn alloy coating as the lower layer has a large coating weight outside the scope of the present invention. In the reference samples Nos. 5 and 6, Nos. 1 and 2 Fe-Zn alloy coatings as the upper layer have large total coating weight outside the scope of the present invention. In the reference samples Nos. 7 and 8, the difference in the ratio of iron content to the coating weight between No. 1 Fe-Zn alloy coating and No. 2 Fe-Zn alloy coating as the upper layer is large outside the scope of the present invention. In the reference sample No. 9, No. 1 Fe-Zn alloy coating as the lower layer has a high ratio of iron content to the coating weight outside the scope of the present invention. In the reference sample No. 10, the sum of the coating weight of No. 1 Fe-Zn alloy coating as the lower layer and the total coating weight of Nos. 1 and 2 Fe-Zn alloy coatings as the upper layer is small outside the scope of the present invention. In reference sample No. 11, the sum of the coating weight of No. 1 Fe-Zn alloy coating as the lower layer and the total coating weight of Nos. 1 to 5 Fe-Zn alloy coatings as the upper layer is large outside the scope of the present invention.

As is clear from Table 1, the reference sample No. 1 comprising a single Fe-Zn alloy coating is inferior in corrosion resistance after coating of the non-formed sheet, and the reference sample No. 2 is inferior in powdering resistance. The reference sample No. 3 comprising No. 1 Fe-Zn alloy coating as the lower layer and No. 1 Fe-Zn alloy coating as the upper layer is inferior in corrosion resistance after painting of the formed sheet since peeloff of No. 1 Fe-Zn alloy coating as the upper layer leads to exposure of No. 1 Fe-Zn alloy coating as the lower layer, which has a lower ratio of iron content to the coating weight. In all the samples of the present invention Nos. 1 to 12, in contrast, each comprising at least two Fe-Zn alloy coatings as the upper layer, forming never leads to exposure of an Fe-Zn alloy coating as the lower layer having a lower ratio of iron content to the coating weight even when the uppermost Fe-Zn alloy coating is peeled off during forming. All the samples of the present invention Nos. 1 to 12 are therefore excellent in all such properties as powdering resistance, corrosion resistance after painting of the non-formed sheet and corrosion resistance after painting of the formed sheet.

The reference sample No. 4, in which, although each of No. 1 Fe-Zn alloy coating as the lower layer and Nos. 1 and 2 Fe-Zn alloy coatings as the upper layer has the same ratio of iron content to the coating weight as in the sample of the present invention No. 1, the coating weight of No. 1 Fe-Zn alloy coating as the lower layer is large outside the scope of the present invention, is inferior in powdering resistance and corrosion resistance after painting of the formed sheet. The reference samples Nos. 5 and 6, in which, although the ratio of iron content to the coating weight of each of No. 1 Fe-Zn alloy coating as the lower layer and Nos. 1 and 2 Fe-Zn alloy coatings as the upper layer and the coating weight of No. 1 Fe-Zn alloy coating as the lower layer are the same as in the sample of the present invention No. 2, the total coating weight of Nos. 1 and 2 Fe-Zn alloy coatings as the upper layer is large outside the scope of the present invention, are all inferior in powdering resistance and corrosion resistance after painting of the formed sheet.

The reference samples Nos. 7 and 8, in which, although the coating weight of No. 1 Fe-Zn alloy coating as the lower layer, the coating weight of each of Nos. 1 and 2 Fe-Zn alloy coatings as the upper layer and the total coating weight of Nos. 1 and 2 Fe-Zn alloy coatings as the upper layer are the same as or similar to those in the sample of the present invention No. 5, the difference in the ratio of iron content to the coating weight between Nos. 1 and 2 Fe-Zn alloy coatings as the upper layer is large outside the scope of the present invention, are inferior in corrosion resistance after painting of both the non-formed sheet and the formed sheet because of the occurrence of galvanic corrosion in Nos. 1 and 2 Fe-Zn alloy coatings as the upper layer.

The reference sample No. 9, in which, although the ratio of iron content to the coating weight of each of Nos. 1 and 2 Fe-Zn alloy coatings as the upper layer, the coating weight of No. 1 Fe-Zn alloy coating as the lower layer, the coating weight of each of Nos. 1 and 2 Fe-Zn alloy coatings as the upper layer and the total coating weight of Nos. 1 and 2 Fe-Zn alloy coatings as the upper layer are within the scope of the present invention, the ratio of iron content to the coating weight of No. 1 Fe-Zn alloy coating as the lower layer is high outside the scope of the present invention, is inferior in powdering resistance and corrosion resistance after coating of the formed sheet. The reference sample No. 10, in which, although the ratio of iron content to the coating weight of No. 1 Fe-Zn alloy coating as the lower layer, the ratio of iron content to the coating weight of each of Nos. 1 and 2 Fe-Zn alloy coatings as the upper layer, the coating weight of No. 1 Fe-Zn alloy coating as the lower layer, the coating weight of each of Nos. 1 and 2 Fe-Zn alloy coatings as the upper layer and the total coating weight of Nos. 1 and 2 Fe-Zn alloy coatings as the upper layer are within the scope of the present invention, the sum of the coating weight of No. 1 Fe-Zn alloy coating as the lower layer and the total coating weight of Nos. 1 and 2 Fe-Zn alloy coatings as the upper layer is small outside the scope of the present invention, is inferior in corrosion resistance after painting of both the non-formed sheet and the formed sheet. The reference sample No. 11, in which, the ratio of iron content to the coating weight of No. 1 Fe-Zn alloy coating as the lower layer, the ratio of iron content to the coating weight of each of Nos. 1 to 5 Fe-Zn alloy coatings as the upper layer, the coating weight of No. 1 Fe-Zn alloy coating as the lower layer, the coating weight of each of Nos. 1 to 5 Fe-Zn alloy coatings as the upper layer and the total coating weight of Nos. 1 to 5 alloy coatings as the upper layer are within the scope of the present invention, the sum of the coating weight of No. 1, Fe-Zn alloy coating as the lower layer and the total coating weight of Nos. 1 to 5 Fe-Zn alloy coatings as the upper layer is large outside the scope of the present invention, is inferior in powdering resistance and corrosion resistance after painting of the formed sheet.

As described above, all the samples of the present invention Nos. 1 to 12 are excellent in all of powdering resistance, corrosion resistance after painting of the non-formed sheet and corrosion resistance after painting of the formed sheet. Particularly the samples of the present invention Nos. 8 to 12, in which the uppermost coating of the Fe-Zn alloy coatings as the upper layer has a ratio of iron content to the coating weight of at least 50 wt. %, are excellent in water-resistant paint adhesivity and appearance of paint film surface. Therefore, the iron-zinc alloy electro-galvanized steel sheets having the Fe-Zn alloy coatings as in the samples of the present invention Nos. 1 to 7 are suitable for such uses as steel sheets for inner sheets of automobile, requiring excellent powdering resistance and corrosion resistance after painting, and the iron-zinc alloy electro-galvanized steel sheets having the Fe-Zn alloy coatings as in the samples of the present invention Nos. 8 to 12 are suitable for such uses as steel sheets for outer sheets of automobile requiring, in addition to powdering resistance and corrosion resistance after painting, excellent water-resistant paint adhesivity and appearance of the paint film surface.

Now, the iron-zinc alloy electro-galvanized steel sheet of the present invention is described in detail, together with concrete conditions for preparation, by means of further examples.

EXAMPLE 2

A sample of the iron-zinc alloy electro-galvanized steel sheet of the present invention (hereinafter referred to as the "sample of the present invention") No. 13 which comprises Nos. 1 to 3 Fe-Zn alloy coatings as the lower layer and Nos. 1 to 7 Fe-Zn alloy coatings as the upper layer, each of which has the coating weight and the ratio of iron content to the coating weight as shown in Table 2, was prepared by subjecting a steel sheet to an electro-galvanizing treatment under the following conditions:

(1) Chemical composition of the galvanizing bath used:

| | |
|---|---|
| Zinc sulfate ($ZnSO_4.7H_2O$) | 500 g/l in total, |
| Iron sulfate ($FeSO_4.7H_2O$) | |
| Sodium sulfate ($Na_2SO_4$) | 30 g/l, |
| Sodium acetate ($CH_3COONa.3H_2O$) | 30 g/l, |
| Citric acid ($C_6H_8O_7$) | 10 g/l, |

(2) Galvanizing conditions:

pH of galvanizing bath: from 2.8 to 3.2,

Temperature of galvanizing bath: 50° C.

When preparing the sample of the present invention No. 13, the ratio of iron content to the coating weight of each of Nos. 1 to 3 Fe-Zn alloy coatings as the lower layer and Nos. 1 to 7 Fe-Zn alloy coatings as the upper layer was altered, by keeping the iron salt ratio and the flow velocity of the galvanizing bath at a constant level and changing the galvanizing current density, as shown also in Table 2.

TABLE 2

| Fe—Zn alloy coating | | coating weight ($g/m^2$) | Ratio of Fe content (wt. %) | Conditions for preparation: Iron salt ratio of galvanizing bath (wt. %) | Galvanizing current density ($A/dm^2$) | Flow velocity of galvanizing bath (m/sec) |
|---|---|---|---|---|---|---|
| Sample of the present invention No. 13 | | | | | | |
| Lower layer | No. 1 | 3 | 10 | 70 | 34 | 3 |
| | No. 2 | 3 | 12 | 70 | 36 | 3 |
| | No. 3 | 3 | 14 | 70 | 38 | 3 |
| Upper layer | No. 1 | 3 | 16 | 70 | 40 | 3 |
| | No. 2 | 3 | 18 | 70 | 42 | 3 |
| | No. 3 | 3 | 20 | 70 | 44 | 3 |
| | No. 4 | 3 | 22 | 70 | 46 | 3 |
| | No. 5 | 3 | 24 | 70 | 48 | 3 |
| | No. 6 | 3 | 26 | 70 | 50 | 3 |
| | No. 7 | 3 | 28 | 70 | 52 | 3 |

EXAMPLE 3

A sample of the iron-zinc alloy electro-galvanized steel sheet of the present invention (hereinafter referred to as the "sample of the present invention") No. 14 which comprises No. 1 Fe-Zn alloy coating as the lower layer and Nos. 1 to 4 Fe-Zn alloy coatings as the upper layer, each of which has the coating weight and the ratio of iron content to the coating weight as shown in Table 3, was prepared by subjecting a steel sheet to an electro-galvanizing treatment with the same chemical composition, pH value and temperature of the galvanizing bath as in Example 2. When preparing the sample of the present invention No. 14, the ratio of iron content to the coating weight of each of No. 1 Fe-Zn alloy coating as the lower layer and Nos. 1 to 4 Fe-Zn alloy coatings as the upper layer was altered, by keeping the galvanizing current density at a constant level and changing the iron salt ratio and the flow velocity of the galvanizing bath, as shown also in Table 3.

TABLE 3

| Fe—Zn alloy coating | | Coating Weight ($g/m^2$) | Ratio of Fe content (wt. %) | Conditions for preparation: Iron salt ratio of galvanizing bath (wt. %) | Galvanizing current density ($A/dm^2$) | Flow velocity of galvanizing bath (m/sec) |
|---|---|---|---|---|---|---|
| Sample of the present invention No. 14 | | | | | | |
| Lower layer | No. 1 | 10 | 12 | 70 | 50 | 5 |
| Upper layer | No. 1 | 10 | 17 | 70 | 50 | 4 |
| | No. 2 | 5 | 25 | 70 | 50 | 3 |
| | No. 3 | 5 | 33 | 80 | 50 | 5 |
| | No. 4 | 5 | 41 | 80 | 50 | 4 |

EXAMPLE 4

A sample of the iron-zinc alloy electro-galvanized steel sheet of the present invention (hereinafter referred to as the "sample of the present invention") No. 15 which comprises No. 1 Fe-Zn alloy coating as the lower layer and Nos. 1 to 5 Fe-Zn alloy coatings as the upper layer, each of which has the coating weight and the ratio of iron content to the coating weight as shown in Table 4, was prepared by subjecting a steel sheet to an electro-galvanizing treatment with the same chemical composition, pH value and temperature of the galvanizing bath as in Example 2. When preparing the sample of the present invention No. 15, the ratio of iron content to the coating weight of each of No. 1 Fe-Zn alloy coating as the lower layer and Nos. 1 to 5 Fe-Zn alloy coatings as the upper layer was altered, by keeping the galvanizing current density at a constant level and changing the iron salt ratio and the flow velocity of the galvanizing bath, as shown also in Table 4.

TABLE 4

| Fe—Zn alloy coating | | Coating weight ($g/m^2$) | Ratio of Fe content (wt. %) | Conditions for preparation: Iron salt ratio of galvanizing bath (wt. %) | Galvanizing current density ($A/dm^2$) | Flow velocity of galvanizing bath (m/sec) |
|---|---|---|---|---|---|---|
| Sample of the present invention No. 15 | | | | | | |
| Lower layer | No. 1 | 10 | 12 | 70 | 50 | 5 |
| Upper layer | No. 1 | 10 | 17 | 70 | 50 | 4 |
| | No. 2 | 2.5 | 25 | 70 | 50 | 3 |
| | No. 3 | 2.5 | 33 | 80 | 50 | 5 |
| | No. 4 | 2.5 | 41 | 80 | 50 | 4 |

TABLE 4-continued

| Fe—Zn alloy coating | Coating weight ($g/m^2$) | Ratio of Fe content (wt. %) | Conditions for preparation: Iron salt ratio of galvanizing bath (wt. %) | Galvanizing current density ($A/dm^2$) | Flow velocity of galvanizing bath (m/sec) |
|---|---|---|---|---|---|
| No. 5 | 2.5 | 50 | 80 | 50 | 3 |

EXAMPLE 5

A sample of the iron-zinc alloy electro-galvanized steel sheet of the present invention (hereinafter referred to as the "sample of the present invention") No. 16 which comprises Nos. 1 and 2 Fe-Zn alloy coatings as the lower layer and Nos. 1 to 9 Fe-Zn alloy coatings as the upper layer, each of which has the coating weight and the ratio of iron content to the coating weight as shown in Table 5, was prepared by subjecting a steel sheet to an electro-galvanizing treatment with the same chemical composition, pH value and temperature of the galvanizing bath as in Example 2. When preparing the sample of the present invention No. 16, the ratio of iron content to the coating weight of each of Nos. 1 and 2 Fe-Zn alloy coatings as the lower layer and Nos. 1 to 9 Fe-Zn alloy coatings as the upper layer was altered, by changing the iron salt ratio and the flow velocity of the galvanizing bath and the galvanizing current density, as shown also in Table 5.

TABLE 5

| Fe—Zn alloy coating | | Coating weight ($g/m^2$) | Ratio of Fe content (wt. %) | Conditions for preparation: Iron salt ratio of galvanizing bath (wt. %) | Galvanizing current density ($A/dm^2$) | Flow velocity of galvanizing bath (m/sec) |
|---|---|---|---|---|---|---|
| Sample of the present invention No. 16 | | | | | | |
| Lower layer | No. 1 | 3 | 10 | 70 | 34 | 3 |
| | No. 2 | 3 | 12 | 70 | 36 | 3 |
| Upper layer | No. 1 | 3 | 20 | 70 | 44 | 3 |
| | No. 2 | 3 | 25 | 70 | 50 | 3 |
| | No. 3 | 3 | 30 | 80 | 33 | 4 |
| | No. 4 | 3 | 35 | 80 | 41 | 4 |
| | No. 5 | 3 | 40 | 80 | 49 | 4 |
| | No. 6 | 3 | 45 | 80 | 57 | 4 |
| | No. 7 | 3 | 50 | 80 | 35 | 2 |
| | No. 8 | 3 | 55 | 80 | 45 | 2 |
| | No. 9 | 3 | 60 | 80 | 55 | 2 |

EXAMPLE 6

A sample of the iron-zinc alloy electro-galvanized steel sheet of the present invention (hereinafter referred to as the "sample of the present invention") No. 17 which comprises Nos. 1 and 2 Fe-Zn alloy coatings as the lower layer and Nos. 1 to 6 Fe-Zn alloy coatings as the upper layer, each of which has the coating weight and the ratio of iron content to the coating weight as shown in Table 6, was prepared by subjecting a steel sheet to an electro-galvanizing treatment with the same chemical composition, pH value and temperature of the galvanizing bath as in Example 2. When preparing the sample of the present invention No. 17, the ratio of iron content to the coating weight of each of Nos. 1 and 2 Fe-Zn alloy coatings as the lower layer and Nos. 1 to 6 Fe-Zn alloy coatings as the upper layer was altered, by keeping the galvanizing current density at a constant level and changing the iron salt ratio and the flow velocity of the galvanizing bath, as shown also in Table 6.

TABLE 6

| Fe—Zn alloy coating | | Coating weight ($g/m^2$) | Ratio of Fe content (wt. %) | Conditions for preparation: Iron salt ratio of galvanizing bath (wt. %) | Galvanizing current density ($A/dm^2$) | Flow velocity of galvanizing bath (m/sec) |
|---|---|---|---|---|---|---|
| Sample of the present invention No. 17 | | | | | | |
| Lower layer | No. 1 | 5 | 8 | 70 | 40 | 4 |
| | No. 2 | 5 | 14 | 70 | 40 | 3 |
| Upper layer | No. 1 | 5 | 25 | 80 | 40 | 5 |
| | No. 2 | 5 | 34 | 80 | 40 | 4 |
| | No. 3 | 2 | 43 | 80 | 40 | 3 |
| | No. 4 | 2 | 53 | 80 | 40 | 2 |
| | No. 5 | 2 | 69 | 80 | 40 | 1 |
| | No. 6 | 2 | 75 | 90 | 40 | 2 |

EXAMPLE 7

A sample of the iron-zinc alloy electro-galvanized steel sheet of the present invention (hereinafter referred to as the "sample of the present invention") No. 18 which comprises Nos. 1 and 2 Fe-Zn alloy coatings as the lower layer and Nos. 1 to 3 Fe-Zn alloy coatings as the upper layer, each of which has the coating weight and the ratio of iron content to the coating weight as shown in Table 7, was prepared by subjecting a steel sheet to an electro-galvanizing treatment with the same chemical composition, pH value and temperature of the galvanizing bath as in Example 2. When preparing the sample of the present invention No. 18, the ratio of iron content to the coating weight of each of Nos. 1 and 2 Fe-Zn alloy coatings as the lower layer and Nos. 1 to 3 Fe-Zn alloy coatings as the upper layer was altered, by changing the iron salt ratio and the flow velocity of the galvanizing bath and the galvanizing current density, as shown also in Table 7.

TABLE 7

| Fe—Zn alloy coating | | Coating weight ($g/m^2$) | Ratio of Fe content (wt. %) | Conditions for preparation: Iron salt ratio of galvanizing bath (wt. %) | Galvanizing current density ($A/dm^2$) | Flow velocity of galvanizing bath (m/sec) |
|---|---|---|---|---|---|---|
| Sample of the present invention No. 18 | | | | | | |
| Lower layer | No. 1 | 3 | 12 | 70 | 36 | 3 |
| | No. 2 | 3 | 8 | 70 | 40 | 4 |
| Upper layer | No. 1 | 10 | 17 | 70 | 50 | 4 |
| | No. 2 | 5 | 25 | 70 | 50 | 3 |
| | No. 3 | 5 | 33 | 80 | 50 | 5 |

EXAMPLE 8

A sample of the iron-zinc alloy electro-galvanized steel sheet of the present invention (hereinafter referred to as the "sample of the present invention ") No. 19 which comprises Nos. 1 to 3 Fe-Zn alloy coatings as the lower layer and Nos. 1 to 4 Fe-Zn alloy coatings as the upper layer, each of which has the coating weight and the ratio of iron content to the coating weight as shown in Table 8, was prepared by subjecting a steel sheet to an electro-galvanizing treatment with the same chemical composition, pH value and temperature of the galvanizing bath as in Example 2. When preparing the sample of the present invention No. 19, the ratio of iron content to the coating weight of each of Nos. 1 to 3 Fe-Zn alloy coatings as the lower layer and Nos. 1 to 4 Fe-Zn alloy coatings as the upper layer was altered, by changing the iron salt ratio and the flow velocity of the galvanizing bath and the galvanizing current density, as shown also in Table 8.

TABLE 8

| Fe—Zn alloy coating | | Coating weight ($g/m^2$) | Ratio of Fe content (wt. %) | Conditions for preparation: Iron salt ratio of galvanizing bath (wt. %) | Galvanizing current density ($A/dm^2$) | Flow velocity of galvanizing bath (m/sec) |
|---|---|---|---|---|---|---|
| Sample of the present invention No. 19 | | | | | | |
| Lower layer | No. 1 | 2 | 12 | 70 | 36 | 3 |
| | No. 2 | 2 | 8 | 70 | 40 | 4 |
| | No. 3 | 2 | 14 | 70 | 40 | 3 |
| Upper layer | No. 1 | 10 | 25 | 80 | 40 | 5 |
| | No. 2 | 2 | 34 | 80 | 40 | 4 |
| | No. 3 | 2 | 43 | 80 | 40 | 3 |
| | No. 4 | 3 | 53 | 80 | 40 | 2 |

On the samples of the present invention Nos. 13 to 19 prepared in the above-mentioned Examples 2 to 8, powdering resistance, corrosion resistance after painting of the non-formed sheet, corrosion resistance after painting of the formed sheet, water-resistant paint adhesivity and appearence of the paint film surface were evaluated by the methods mentioned above. The results of evaluation are indicated in Table 9. As is clear from Table 9, all the samples of the present invention Nos. 13 to 19 are excellent in all of powdering resistance, corrosion resistance after painting of the non-formed sheet, and corrosion resistance after painting of the formed sheet. Particularly, the samples of the present invention Nos. 15, 16, 17 and 19 in which the uppermost coating of the Fe-Zn alloy coatings as the upper layer has a ratio of iron content to the coating weight of at least 50 wt.%, are excellent also in water-resistant paint adhesivity and appearence of the paint film surface.

TABLE 9

| Samples of the present invention | Powdering resistance | Corrosion resistance after painting of non-formed sheet | Corrosion resistance after painting of formed sheet | Water-resistant paint adhesivity | Appearance of paint film surface |
|---|---|---|---|---|---|
| No. 13 | O | O | O | X | X |
| No. 14 | O | O | O | X | X |
| No. 15 | O | O | O | O | O |
| No. 16 | O | O | O | O | O |
| No. 17 | O | O | O | O | O |
| No. 18 | O | O | O | X | X |
| No. 19 | O | O | O | O | O |

According to the iron-zinc alloy electro-galvanized steel sheet of the present invention, as described above in detail, it is possible to obtain excellent bare corrosion resistance of the Fe-Zn alloy coating itself and corrosion resistance after painting, without occurrence of powdering of the Fe-Zn alloy coating even in a severe forming such as that of a press, thus providing many industrially useful effects.

What is claimed is:

1. An iron-zinc alloy electro-galvanized steel sheet having a plurality of iron-zinc alloy coatings, which comprises:

at least one iron-zinc alloy coating as the lower layer, formed on at least one surface of a steel sheet; and at least two iron-zinc alloy coating as the upper layer, formed on said at least one iron-zinc alloy coating as the lower layer, the ratio of iron content to the coating weight of each of said at least one iron-zinc alloy coating as the upper layer being higher than the ratio of iron content to the coating weight of each of said at least one iron-zinc alloy coating as the lower layer;

the ratio of iron content to the coating weight of each of said at least one iron-zinc alloy coating as the lower layer being within the range of from 1 to 15 wt.%, and the total coating weight of said at least one iron-zinc alloy coating as the lower layer being within the range of from 1 to 50 g/m$^2$ per side of said steel sheet;

the ratio of iron content to the coating weight of each of said at least two iron-zinc alloy coatings as the upper layer being over 15 wt.%, the ratio of iron content to the coating weight gradually increasing from the innermost coating toward the outermost coating of said at least two iron-zinc alloy coatings as the upper layer, the difference in the ratio of iron content to the coating weight between two adjacent coatings of said at least two iron-zinc alloy coatings as the upper layer being within the range of from 1 to 15 wt.%, and the total coating weight of said at least two iron-zinc alloy coatings as the upper layer being within the range of from 1 to 40 g/m$^2$ per side of said steel sheet;

the difference in the ratio of iron content to the coating weight between the uppermost coating of said at least one iron-zinc alloy coating as the lower layer and the lowermost coating of said at least two iron-zinc alloy coatings as the upper layer being within the range of from 1 to 15 wt.%; and the sum of said total coating weight of said at least one iron-zinc alloy coating as the lower layer and said total coating weight of said at least two iron-zinc alloy coatings as the upper layer being within the range of from 10 to 75 g/m$^2$ per side of said steel sheet.

2. The iron-zinc alloy electro-galvanized steel sheet as claimed in claim 1, wherein:

said at least one iron-zinc alloy coating as the lower layer comprising at least two iron-zinc alloy coatings, and two adjacent coatings of said at least two iron-zinc alloy coatings as the lower layer being different from each other in the ratio of iron content to the coating weight by a value within the range of from 1 to 14 wt.%.

3. The iron-zinc alloy electro-galvanized steel sheet as claimed in claim 1, wherein:

the ratio of iron content to the coating weight of the uppermost coating of said at least two iron-zinc alloy coatings as the upper layer being at least 50 wt.%.

4. The iron-zinc alloy electro-galvanized steel sheet as claimed in claim 2, wherein:

the ratio of iron content to the coating weight of the uppermost coating of said at least two iron-zinc alloy coatings as the upper layer being at least 50 wt.%.

5. The iron-zinc alloy electro-galvanized steel sheet as claimed in any one of claims 1 to 3, wherein:

the ratio of iron content to the coating weight of each of said at least two iron-zinc alloy coatings as the upper layer increasing from the innermost coating toward the outermost coating of said at least two iron-zinc alloy coatings as the upper layer, at a constant rate within the range of from 1 to 15 wt.%.

6. The iron-zinc alloy electro-galvanized steel sheet as claimed in claim 4, wherein:

the ratio of iron content to the coating weight of each of said at least two iron-zinc alloy coatings as the upper layer increasing from the innermost coating toward the outermost coating of said at least two iron-zinc alloy coatings as the upper layer, at a constant rate within the range of from 1 to 15 wt.%.

7. The iron-zinc alloy electro-galvanized steel sheet as claimed in any one of claims 1 to 3, wherein:

the ratio of iron content to the coating weight of each of said at least two iron-zinc alloy coatings as the upper layer increasing from the innermost coating toward the outermost coating of said at least two iron-zinc alloy coatings as the upper layer, at a rate increasing in this direction within the range of from 1 to 15 wt.%.

8. The iron-zinc alloy electro-galvanized steel sheet as claimed in claim 4, wherein:

the ratio of iron content to the coating weight of each of said at least two iron-zinc alloy coatings as the upper layer increasing from the innermost coating toward the outermost coating of said at least two iron-zinc alloy coatings as the upper layer, at a rate increasing in this direction within the range of from 1 to 15 wt.%.

9. The iron-zinc alloy electro-galvanized steel sheet as claimed in any one of claims 1 to 3, wherein:

the ratio of iron content to the coating weight of each of said at least two iron-zinc alloy coatings as the upper layer increasing from the innermost coating toward the outermost coating of said at least two iron-zinc alloy coatings as the upper layer, at a rate decreasing in this direction within the range of from 1 to 15 wt.%.

10. The iron-zinc alloy electro-galvanized steel sheet as claimed in claim 4, wherein:

the ratio of iron content to the coating weight of each of said at least two iron-zinc alloy coatings as the upper layer increasing from the innermost coating toward the outermost coating of said at least two iron-zinc alloy coatings as the upper layer, at a rate decreasing in this direction within the range of from 1 to 15 wt.%.

* * * * *

UNITED STATES PATENT AND TRADEMARK OFFICE

CERTIFICATE OF CORRECTION

PATENT NO. : 4,543,300 PAGE 1 OF 2

DATED : September 24, 1985

INVENTOR(S) : Tomihiro HARA et al

It is certified that error appears in the above-identified patent and that said Letters Patent is hereby corrected as shown below:

Column 4, line 45, change "electro-gavanized" to --electro-galvanized--;

Column 5, line 4, change "forth" to --fourth--;

Column 5, line 32, change "susceptibel" to --susceptible--;

Column 5, line 56, after "having" change "a" to --an--;

Column 6, line 1, change "kg/$m^2$" to --g/$m^2$--;

Column 9, line 65, change "tenside" to --tensile--;

Column 15, line 54, change "inventigated" to --investigated--;

Column 15, line 68, change "appearence" to --appearance--;

Column 16, line 4, before ": almost" insert --O--;

UNITED STATES PATENT AND TRADEMARK OFFICE

CERTIFICATE OF CORRECTION

PATENT NO. : 4,543,300 PAGE 2 OF 2

DATED : September 24, 1985

INVENTOR(S) : Tomihiro HARA et al

It is certified that error appears in the above-identified patent and that said Letters Patent is hereby corrected as shown below:

Column 23, line 61, change "appearence" to --appearance--;

Column 24, line 63, change "coating" to --coatings--;

Column 24, line 66, change "one" to --two--;

Column 24, line 67, change "coating" to --coatings--.

Signed and Sealed this

*Twenty-sixth* Day of *August 1986*

[SEAL]

*Attest:*

DONALD J. QUIGG

*Attesting Officer* *Commissioner of Patents and Trademarks*